United States Patent [19]

Shyu

[11] Patent Number: 4,539,757

[45] Date of Patent: Sep. 10, 1985

[54] DRAWING IMPLEMENT

[76] Inventor: Shiang C. Shyu, No. 119, Kung Chien Rd., Kung Kuan, Miaoli Hsien, Taiwan

[21] Appl. No.: 557,344

[22] Filed: Nov. 30, 1983

[51] Int. Cl.[3] ..... H01F 1/00

[52] U.S. Cl. ..... 33/177; 33/DIG. 1; 428/693; 428/900

[58] Field of Search ..... 428/11, 55, 900, 692–693; 29/460; 33/DIG. 1, 177

[56] References Cited

U.S. PATENT DOCUMENTS

| | | | |
|---|---|---|---|
| 2,094,529 | 9/1937 | Fisher | 428/11 X |
| 2,790,245 | 4/1957 | Wilkes | 33/177 |
| 3,147,176 | 9/1964 | Haslam | 428/55 |
| 3,159,517 | 12/1964 | Schornstheimer et al. | 428/900 X |
| 3,189,981 | 6/1965 | Genin et al. | 428/900 X |
| 3,256,442 | 6/1966 | Sedlak | 428/900 X |
| 3,483,494 | 12/1969 | Cromie | 428/900 X |
| 3,515,625 | 6/1970 | Sedlak et al. | 428/900 X |
| 3,615,993 | 10/1971 | French | 428/900 X |
| 3,724,083 | 4/1973 | Mehl | 33/177 |
| 4,144,108 | 3/1979 | Gidley et al. | 428/900 X |

*Primary Examiner*—Henry F. Epstein

[57] ABSTRACT

Disclosed is a drafting implement to aid a draftsman in drawing curves. The implement may be called a Curve Stripe. The implement includes an elongated soft metal core having a plurality of openings formed therein at intervals along the core. Magnetic beads are disposed in the openings and have at least one flat surface which is disposed normal to the elongated axis of the core and projects outwardly therefrom. A rectangular strip element is disposed adjacent to the core and arranged to inhibit motion thereof in a direction normal to the at least one surface of the beads. A pliable plastic jacket is provided to surround the core, the strip element and the beads, the jacket having openings therein matching the at least one surface of the beads.

3 Claims, 1 Drawing Figure

DRAWING IMPLEMENT

BACKGROUND OF THE INVENTION

The instant invention is directed to a drafting implement to aid a draftsman in drawing curves. The implement may be called a curve stripe.

In the prior art, curve stripes have been used by draftsmen working at sloped drawing tables to assist the draftsman in drawing curves on their drawings. During use, the prior art curve stripe cannot be fixed on the sloped drawing table. Thus, it can typically only be conveniently used for a relatively short drawing distance. If the prior art curve stripe is used for drawing a curve of relatively long distance, the curve stripe could easily move out of its desired line so that it no longer follows the curve originally desired by the draftsman.

The present invention overcomes this difficulty with prior art curve stripes by providing magnetic beads within the curve strip. Thus, when the draftsman prepares a drawing upon a magnetic pad and utilizes the curve stripe, the steel beads within the curve stripe are attracted to the magnetic pad thereby fixing the curve stripe in any curve desired by the draftsman. The curve stripe will not fall off the draftsman's drawing table even if the drawing table is given a relatively large gradient or slope. When the draftsman draws a relatively long distance curve, the beads in the curve stripe keep it from moving from the position desired by the draftsman.

DETAILED DESCRIPTION

Figure 1:
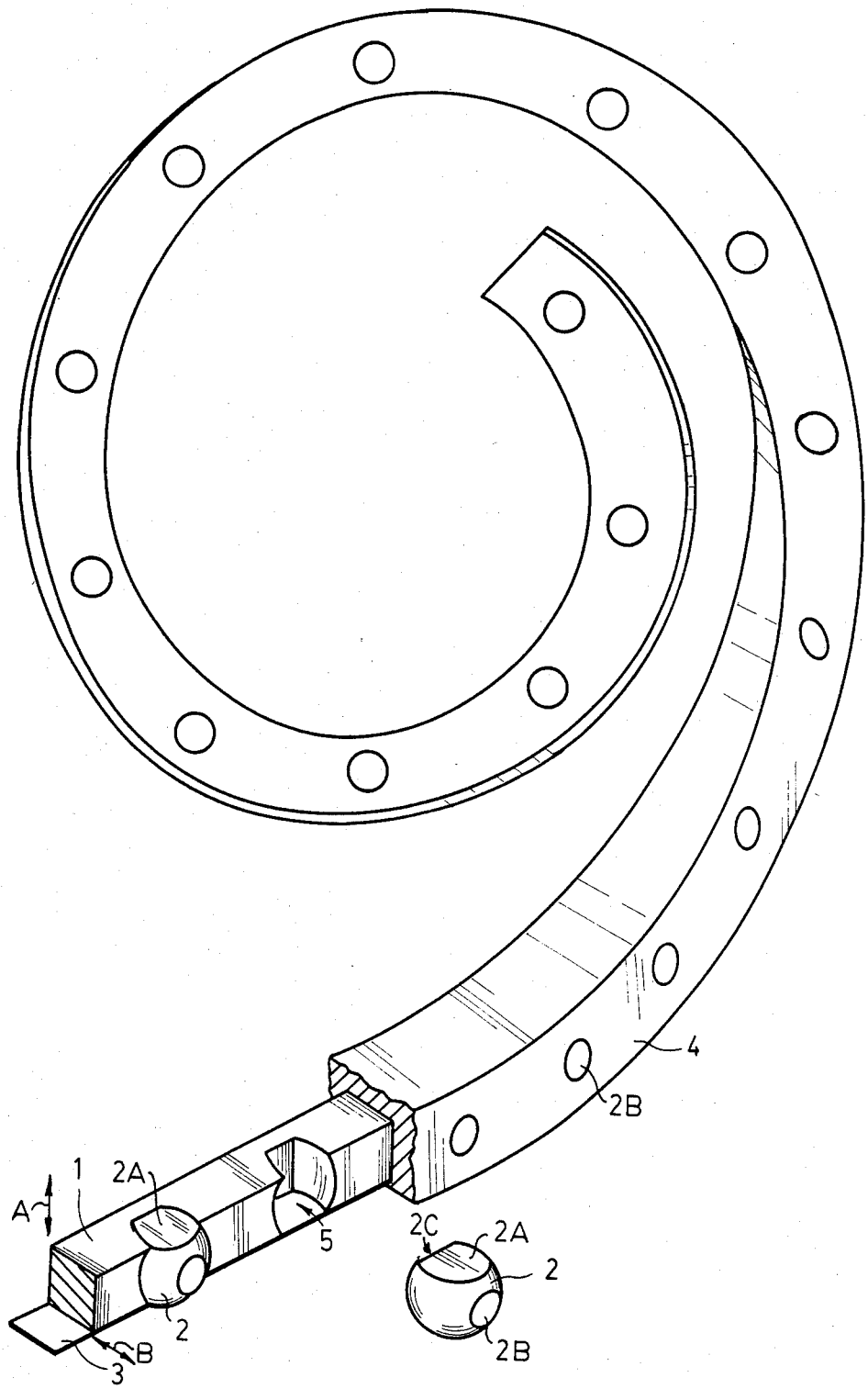
FIG. 1 is a partially cut away perspective view of a curve stripe drawing implement of the present invention.

The curve stripe drawing implement of the present invention is depicted in FIG. 1. The curve stripe includes a core (1) of a soft pliable metal and a long iron strip (3) which is flat, rectangular in cross section and placed adjacent the soft metal core (1) when the two of them are encased in a pliable plastic jacket (4). The core (1) is provided with a series of openings (5) therein for receiving a plurality of beads (2). The beads are made of a non-corrosive, magnetic metal and are ground so as to have four flattened surfaces, three of which surfaces 2A, 2B and 2C, can be seen in FIG. 1. Two of the surfaces should match the width of the soft metal core (1), but only one of these surfaces, namely surface 2A, can be seen in the Figure. The back surface of 2C of the beads is flat and mates with the flat surface of opening (5) to prevent the beads from moving at will and to make the other sides of the plurality of beads, namely surfaces 2B, to be firmly drawn by the associated magnetic pad.

The openings (5) in core (1) are preferably formed by drilling holes in core (1), which drilling is preferably accomplished when the soft metal core has first been bent. Thereafter, when the soft metal core recovers its normal shape, the hole (5) drilled in the core will naturally have a semi-circular configuration so as to grasp beads (2). Since iron strip (3) keeps the curve stripe drawing implement from being moved in the direction noted by arrows B, it also acts to keep beads (2) in their proper places in openings (5) in core (1). Of course, those skilled in the art will appreciate that instead of using round beads (2), that cylinders could be used instead having a curve shape at their contact points so as to retain them in their proper positions by jacket (4). However, it is believed that it is perferable to use ground beads (2) instead of cylinders since the walls of opening (5) can be made semicircular so as to grasp the beads and keep them from popping out of the curve stripe drawing implement.

The pliable plastic jacket (4) has openings therein which match surfaces 2B.

I claim:

1. A curve stripe drawing implement for use with a magnetic pad, said drawing implement comprising:
   (a) an elongated soft metal core having a plurality of openings formed therein at intervals along the core;
   (b) a plurality of magnetic beads having at least one flat surface, said beads being disposed in said openings in said core and being arranged such that said at least one flat metal surface is disposed normal to the elongated axis of the core and projects outwardly therefrom;
   (c) a strip element which is rectangular in cross section and which is disposed adjacent said core and arranged to inhibit movement thereof in a direction normal to said at least one surface of said beads; and
   (d) a pliable plastic jacket surrounding said core, said strip element and said beads, said jacket having openings therein matching said at least one surface of said beads.

2. The implement according to claim 1, wherein said beads have at least another ground surface disposed parallel to said first mentioned at least one surface, said openings in said core member being defined by a flat back surface and semicircular side surfaces, the flat back surface mating with said at least another surface of the bead disposed therein.

3. The implement as claimed in claim 2, wherein said core is rectangular in cross section in the regions where no beads are disposed therein and wherein said beads have top and bottom ground surfaces which are coplanar with two of the walls of the rectangular core.

* * * * *